US010113438B2

(12) United States Patent
Edwards et al.

(10) Patent No.: US 10,113,438 B2
(45) Date of Patent: Oct. 30, 2018

(54) STATOR VANE SHIPLAP SEAL ASSEMBLY

(71) Applicant: United Technologies Corporation, Hartford, CT (US)

(72) Inventors: William Edwards, Stratham, NH (US); Jeffrey Ponchak, North Berwick, ME (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 349 days.

(21) Appl. No.: 15/047,396

(22) Filed: Feb. 18, 2016

(65) Prior Publication Data

US 2017/0241283 A1 Aug. 24, 2017

(51) Int. Cl.
*F01D 11/00* (2006.01)
*F01D 9/04* (2006.01)

(52) U.S. Cl.
CPC ..... *F01D 11/005* (2013.01); *F01D 9/041* (2013.01); *F05D 2220/32* (2013.01); *F05D 2230/12* (2013.01); *F05D 2230/51* (2013.01); *F05D 2240/12* (2013.01); *F05D 2240/55* (2013.01)

(58) Field of Classification Search
CPC ..... F01D 11/005; F01D 11/008; F01D 9/04; F01D 9/041; F01D 5/18; F01D 5/187; F01D 5/188; F05D 224/80; F05D 224/81
See application file for complete search history.

(56) References Cited

U.S. PATENT DOCUMENTS 4,767,260 A * 8/1988 Clevenger ..... F01D 9/041 415/115
2006/0245715 A1 11/2006 Matsumoto
2009/0191053 A1* 7/2009 Bridge ..... F01D 5/225 415/208.2
2010/0129211 A1 5/2010 Hart
2015/0030443 A1 1/2015 Richardson

FOREIGN PATENT DOCUMENTS

| | | |
|---|---|---|
| DE | 102009029587 | 3/2011 |
| EP | 1275819 | 1/2003 |
| JP | H01310104 | 12/1989 |
| WO | 2006100256 | 9/2006 |
| WO | 2012041651 | 4/2012 |

OTHER PUBLICATIONS

EP Search Report dated Oct. 17, 2017 in EP Application No. 17156355.4.

* cited by examiner

*Primary Examiner* — Logan M Kraft
*Assistant Examiner* — John S Hunter, Jr.
(74) *Attorney, Agent, or Firm* — Snell & Wilmer, L.L.P.

(57) ABSTRACT

A stator vane shiplap assembly is provided. The stator vane shiplap assembly may comprise a plurality of stator clusters, coupled together to form an annular shape. Each stator cluster may comprise a shiplap stator shroud and a plurality of stator vanes. The shiplap stator shroud may comprise a female end and a male end, with each end comprising a complimentary forward shiplap surface and outward shiplap surface. In response to a coupling of adjacent shiplap stator shrouds, the female forward shiplap surface and the female outward shiplap surface may form a compound shiplap seal joint with the male forward shiplap surface and the male outward shiplap surface. A feather seal may also be introduced between the coupling of adjacent shiplap stator shrouds.

20 Claims, 5 Drawing Sheets

STATOR VANE SHIPLAP SEAL ASSEMBLY

FIELD

The present disclosure relates to gas turbine engines, and more specifically, to a stator vane seal assembly for gas turbine engines.

BACKGROUND

Gas turbine engines typically include a compressor section to pressurize inflowing air, a combustor section to burn a fuel in the presence of the pressurized air, and a turbine section to extract energy from the resulting combustion gases. The compressor section may include a plurality of rotor blades separated by a plurality of stator vane assemblies mounted within the engine casing. Each stator vane assembly may comprise one or more stator shrouds coupled together end to end to form an annular structure. Typically, a small, flat metal part (sometimes referred to as a feather seal) may be inserted horizontally between the connected ends of stator shrouds to minimize air flow leakage from the pressurized gas path. However, gaps on the radially inward and/or radially outward side of the feather seal may still exist as the adjacent stator shrouds separate due to thermal and gas loads, resulting in air flow leakage in the radial and axial direction. Air flow leakage may result in overall loss in performance to the gas turbine engine.

SUMMARY

In various embodiments, a stator vane ship lap seal assembly is disclosed. A stator vane shiplap seal assembly may comprise a first shiplap stator cluster coupled to a second shiplap stator cluster to form an annular shape. Each shiplap stator cluster may comprise a shiplap stator shroud and a plurality of stator vanes coupled to the axially inward surface of the shiplap stator shroud. The shiplap stator shroud may have an axially outward surface and an axially inward surface, and a female end opposite of a male end. The female end may comprise a female forward shiplap surface and a female outward shiplap surface. The male end may comprise a male forward shiplap surface and a male outward shiplap surface. The female forward shiplap surface may be complimentary to the male forward shiplap surface, forming a first ship lap seal in response to the first shiplap stator cluster being coupled to the second shiplap stator cluster. The female outward shiplap surface may be complimentary to the male outward shiplap surface, forming a ship lap seal in response to the first shiplap stator cluster being coupled to the second shiplap stator cluster.

In various embodiments, the stator vane ship lap seal assembly may also comprise a feather seal slot machined into the female end and the male end, and configured to align in response to the coupling of the first shiplap stator cluster to the second shiplap stator cluster. A feather seal may be located within the feather seal slot. The female forward shiplap surface and the female outward shiplap surface may be formed by machining. The female forward shiplap surface and the female outward shiplap surface may also be formed through electrical discharge machining. The male forward shiplap surface and the male outward shiplap surface may be formed by machining. The male forward shiplap surface and the male outward shiplap surface may also be formed through electrical discharge machining.

In various embodiments, a shiplap stator cluster is disclosed. The shiplap stator cluster may comprise a shiplap stator shroud and a plurality of stator vanes coupled to the axially inward surface of the shiplap stator shroud. The shiplap stator shroud may have an axially outward surface and an axially inward surface, and a female end opposite of a male end. The female end may comprise a female forward shiplap surface and a female outward shiplap surface. The male end may comprise a male forward shiplap surface and a male outward shiplap surface. The female forward shiplap surface may be complimentary to the male forward shiplap surface, forming a first ship lap seal in response to the shiplap stator cluster being coupled to a second shiplap stator cluster. The female outward shiplap surface may be complimentary to the male outward shiplap surface, forming a ship lap seal in response to the shiplap stator cluster being coupled to the second shiplap stator cluster.

In various embodiments, the axially outward surface of the shiplap stator cluster may be configured to operatively couple to an interior of a compressor section in a gas turbine engine. The female forward shiplap surface and the female outward shiplap surface may be formed by machining. The female forward shiplap surface and the female outward shiplap surface may also be formed through electrical discharge machining. The male forward shiplap surface and the male outward shiplap surface may be formed by machining. The male forward shiplap surface and the male outward shiplap surface may also be formed through electrical discharge machining.

In various embodiments, a gas turbine engine is disclosed. The gas turbine engine may comprise a compressor section and a stator vane shiplap seal assembly located within the compression section. The stator vane shiplap seal assembly may comprise a first shiplap stator cluster coupled to a second shiplap stator cluster to form an annular shape. Each shiplap stator cluster may comprise a shiplap stator shroud and a plurality of stator vanes coupled to the axially inward surface of the shiplap stator shroud. The shiplap stator shroud may have an axially outward surface and an axially inward surface, and a female end opposite of a male end. The female end may comprise a female forward shiplap surface and a female outward shiplap surface. The male end may comprise a male forward shiplap surface and a male outward shiplap surface. The female forward shiplap surface may be complimentary to the male forward shiplap surface, forming a first ship lap seal in response to the first shiplap stator cluster being coupled to the second shiplap stator cluster. The female outward shiplap surface may be complimentary to the male outward shiplap surface, forming a ship lap seal in response to the first shiplap stator cluster being coupled to the second shiplap stator cluster.

In various embodiments, the gas turbine engine may also comprise a feather seal slot machined into the female end and the male end, and configured to align in response to the coupling of the first shiplap stator cluster to the second shiplap stator cluster. A feather seal may be located within the feather seal slot. The female forward shiplap surface and the female outward shiplap surface may be formed by machining. The female forward shiplap surface and the female outward shiplap surface may also be formed through electrical discharge machining. The male forward shiplap surface and the male outward shiplap surface may be formed by machining. The male forward shiplap surface and the male outward shiplap surface may also be formed through electrical discharge machining.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation.

The scope of the disclosure is defined by the appended claims and their legal equivalents rather than by merely the examples described. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, coupled, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts but not necessarily to denote the same or different materials.

As used herein, "aft" refers to the direction associated with the tail (e.g., the back end) of an aircraft, or generally, to the direction of exhaust of the gas turbine engine. As used herein, "forward" refers to the direction associated with the nose (e.g., the front end) of an aircraft, or generally, to the direction of flight or motion.

Figure 1:
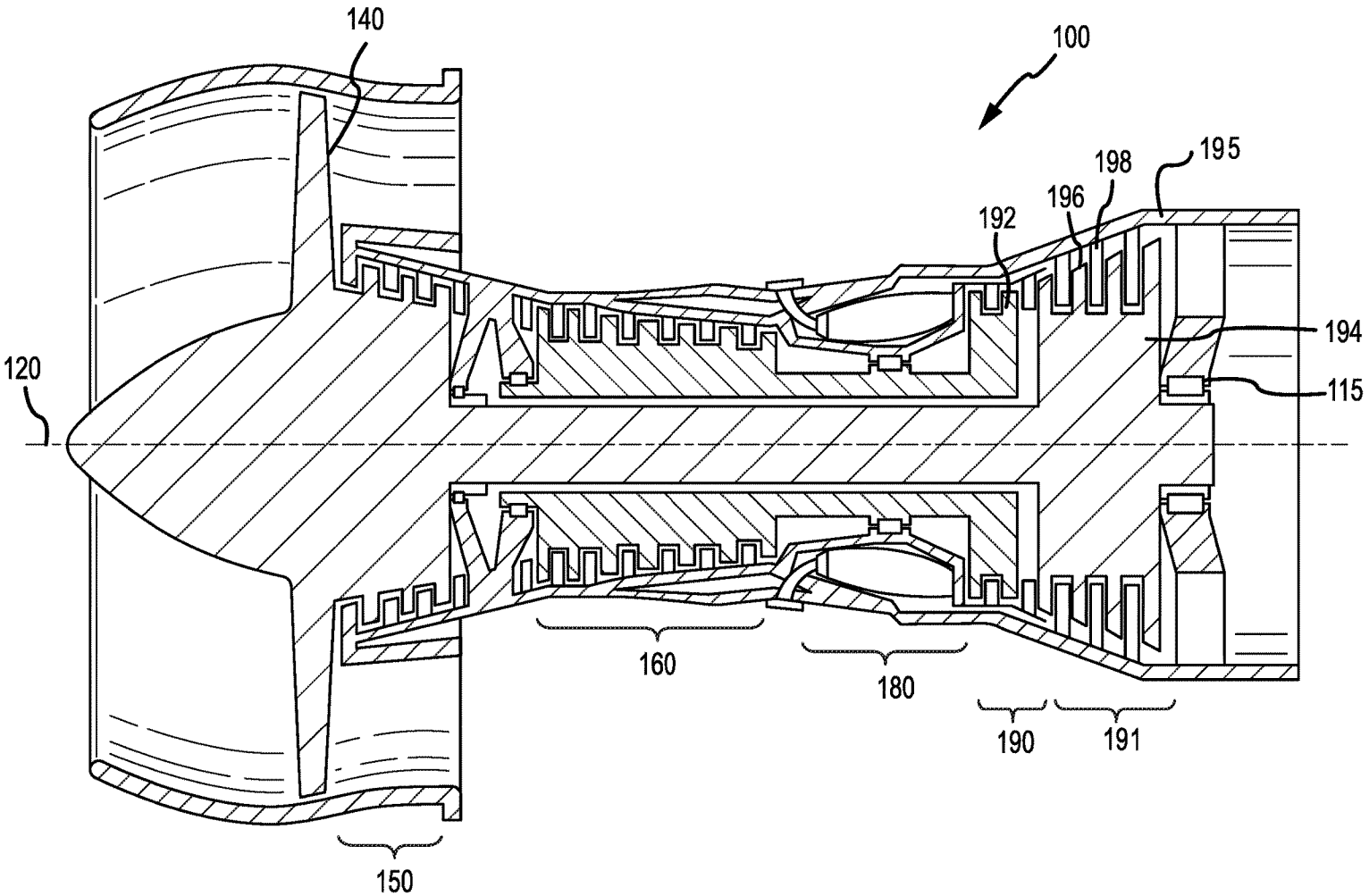
FIG. 1 illustrates a gas turbine engine, in accordance with various embodiments.
Figure 2A:
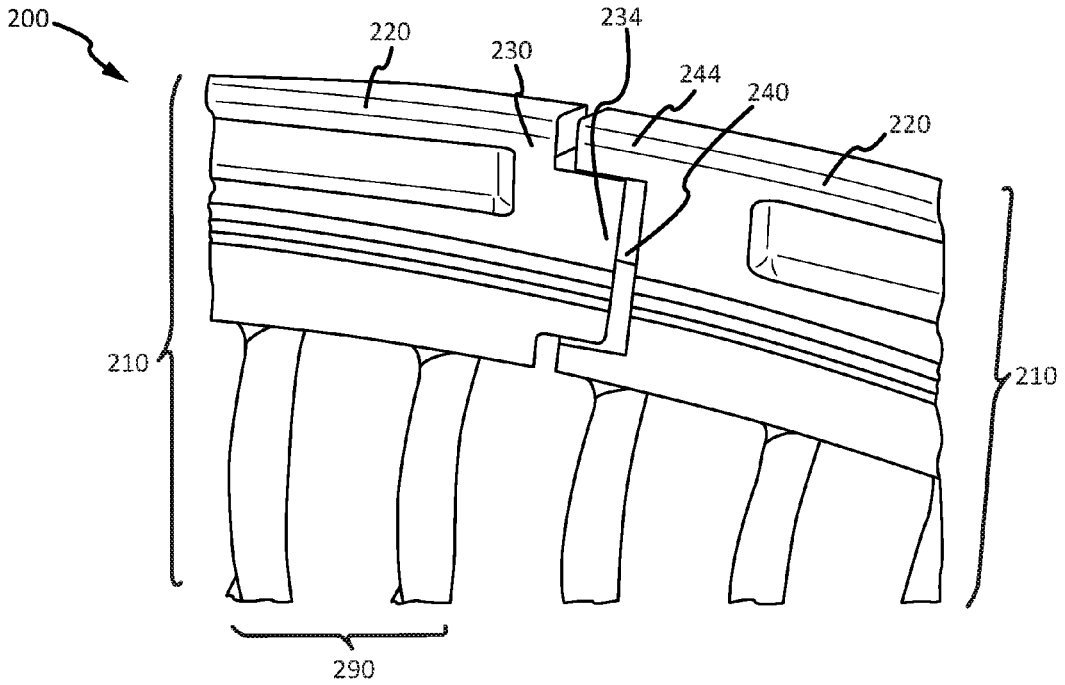
FIG. 2A illustrates a perspective side view of a stator vane shiplap seal assembly, in accordance with various embodiments.
Figure 2B:
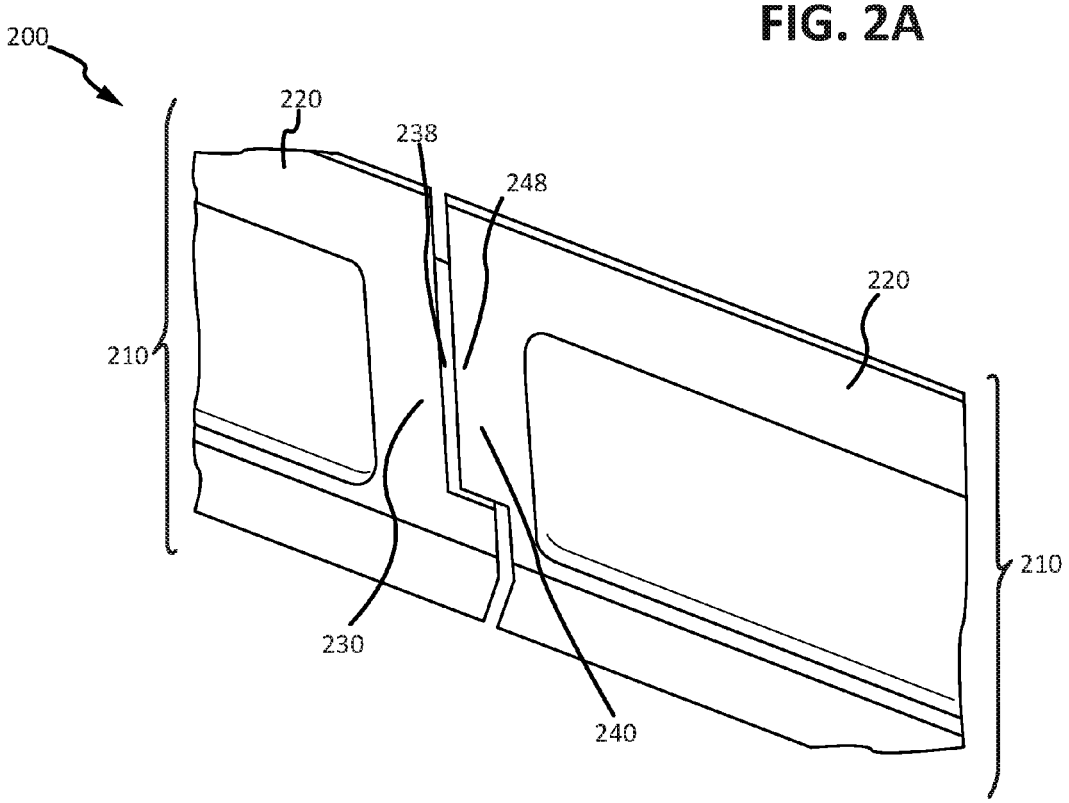
FIG. 2B illustrates a perspective top view of a stator vane shiplap seal assembly, in accordance with various embodiments.
Figure 2C:
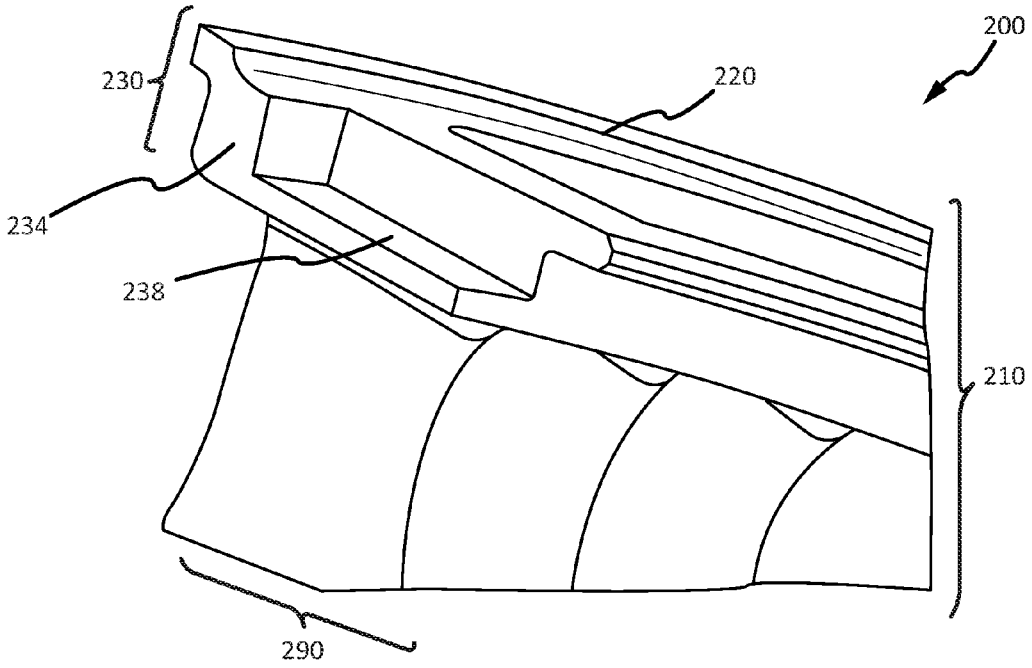
FIG. 2C illustrates a perspective view of a female end of a stator vane shiplap seal assembly, in accordance with various embodiments.
Figure 2D:
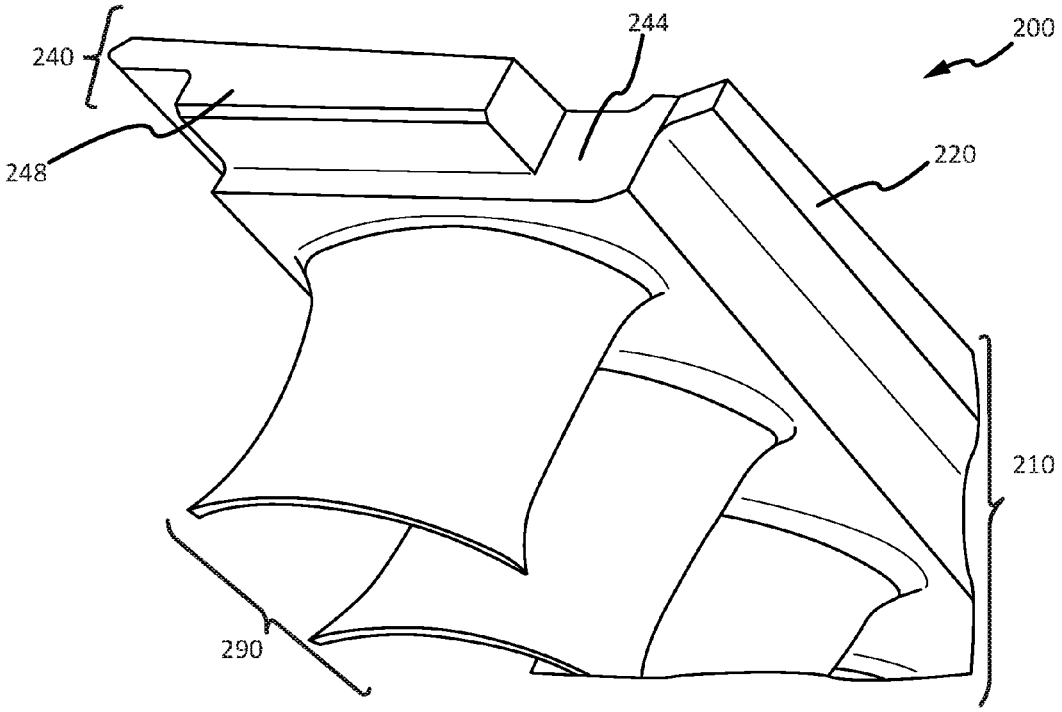
FIG. 2D illustrates a perspective view of a male end of a stator vane shiplap seal assembly, in accordance with various embodiments.

In various embodiments, and with reference to FIG. 1, a gas turbine engine 100 (such as a turbofan gas turbine engine) is illustrated. Gas turbine engine 100 is disposed about axial centerline axis 120, which may also be referred to as axis of rotation 120. Gas turbine engine 100 may comprise a fan 140, compressor sections 150 and 160, a combustion section 180, and turbine sections 190, 191. The fan 140 may drive air into compressor sections 150, 160, which may further drive air along a core flow path for compression and communication into the combustion section 180. Air compressed in the compressor sections 150, 160 may be mixed with fuel and burned in combustion section 180 and expanded across the turbine sections 190, 191. The turbine sections 190, 191 may include high pressure rotors 192 and low pressure rotors 194, which rotate in response to the expansion. The turbine sections 190, 191 may comprise alternating rows of rotary airfoils or rotor blades 196 and stator vane assemblies 198, housed within an engine casing 195. Cooling air may be supplied to the turbine sections 190, 191 from the compressor sections 150, 160. A plurality of bearings 115 may support spools in the gas turbine engine 100. FIG. 1 provides a general understanding of the sections in a gas turbine engine, and is not intended to limit the disclosure. The present disclosure may extend to all types of applications and to all types of turbine engines, including turbofan gas turbine engines and turbojet engines.

In various embodiments, and with reference to FIGS. 2A-2D, a stator vane shiplap seal assembly 200 is disclosed. Stator vane shiplap seal assembly 200 may be configured to provide a seal between adjacent stator clusters. In this regard, stator vane shiplap seal assembly 200 may provide sealing against air flow leakage in both the axial direction and the radial direction (in relation to axis of rotation 120), in between adjacent stator clusters. Moreover, stator vane shiplap seal assembly 200 may provide improved sealing against air flow leakage without the use of a feather seal, although a feather seal may also be implemented if so desired.

In various embodiments, stator vane shiplap seal assembly 200 may provide a seal geometry through the use of a compound shiplap connection between adjacent stator clusters. A shiplap joint may comprise an end-to-end connection wherein a first end of the connection is configured with a protrusion and a groove, and a second end of the connection is configured with complimentary protrusion and groove. The protrusion of the first end may align with the groove of the second end, and the groove of the first end may align with the protrusion of the second end, when forming the shiplap joint. A compound shiplap configuration may comprise at least two shiplap joints on the same end: a shiplap joint to seal air flow along the radial direction, and a shiplap joint to seal air along the axial direction. The compound shiplap configuration may minimize the inter-segment gap between adjacent stator shrouds by creating overlap between the adjacent stator shrouds, further tending to minimize air flow leakage. The compound shiplap configuration may also tend to minimize air flow leakage by providing a more tortuous sealing path from which air may escape. In this regard, the twists and turns exhibited in a compound shiplap may inhibit the amount of air that may be leaked at a given time.

In various embodiments, stator vane shiplap seal assembly 200 may be located within any suitable location in gas turbine engine 100. Stator vane shiplap seal assembly 200 may couple to the inside of gas turbine engine 100 using any suitable method known in the art. For example, stator vane shiplap seal assembly 200 may comprise a shroud tab located on a radially outward surface of stator vane shiplap seal assembly 200, configured to couple with a slot on the inside of gas turbine engine 100. Stator vane shiplap seal assembly 200 may be made and assembled using any suitable method in the art. Stator vane shiplap seal assembly 200 may also comprise any suitable material, such as a metallic material including, but not limited to, steel and/or an austenitic nickel-chromium-based alloy.

In various embodiments, stator vane shiplap seal assembly 200 may comprise at least one stator cluster 210. A plurality of stator clusters 210 may be coupled together, end to end, to form a full ring stator vane shiplap seal assembly 200 (as discussed previously). In various embodiments, stator cluster 210 may comprise a shiplap stator shroud 220 and an at least one stator vane 290. The stator vanes 290 may be coupled to the radially inward surface of shiplap stator shroud 220, and disposed in an axial direction towards axis of rotation 120. Stator vanes 290 may comprise any suitable type of stator vane, and may couple to shiplap stator shroud 220 using any suitable method.

In various embodiments, shiplap stator shroud 220 may comprise any suitable stator shroud capable of coupling at one surface to the radially inward side of an engine casing, and operatively coupling at the opposite surface to stator vanes 290. Shiplap stator shroud 220 may also comprise any suitable anti-rotation mechanism on the surface coupled to the radially inward side of the engine casing, such as, for example, an anti-rotation slot and/or other similar type of anti-rotation mechanism. Shiplap stator shroud 220 may comprise a female end 230 and a male end 240. Female end 230 may comprise the end surface of shiplap stator shroud 220, opposite of male end 240. Male end 240 likewise may comprise the opposite end surface of shiplap stator shroud 220. Female end 230 may be configured to operatively couple to male end 240 of a second shiplap stator shroud. In this regard, stator vane shiplap seal assembly 200 may be formed by coupling female end 230 of a first shiplap stator shroud to male end 240 of a second adjacent shiplap stator shroud.

In various embodiments, female end 230 may comprise a female forward shiplap surface 234 and a female outward shiplap surface 238. Female forward shiplap surface 234 may comprise a portion of female end 230 located on an axially outward edge of shiplap stator shroud 220 and formed as a shiplap joint. Female outward shiplap surface 238 may comprise a portion of female end 230 located on a radially outward edge of shiplap stator shroud 220 and formed as a shiplap joint. In various embodiments, female forward shiplap surface 234 and female outward shiplap surface 238 may be formed into a shiplap joint using any suitable method. For example, female forward shiplap surface 234 and female outward shiplap surface 238 may be milled or be otherwise machined down to form a shiplap joint. Similarly, female forward shiplap surface 234 and female outward shiplap surface 238 may be formed through electrical discharge machining ("EDM") wherein the desired shiplap joint is obtained by using electrical discharges to erode the metal surface of female end 230.

In various embodiments, male end 240 may comprise a male forward shiplap surface 244 and a male outward shiplap surface 248. Male forward shiplap surface 244 may comprise a portion of male end 240 located on an axially outward edge of shiplap stator shroud 220 and formed as a shiplap joint. Male outward shiplap surface 248 may comprise a portion of male end 240 located on a radially outward edge of shiplap stator shroud 220 and formed as a shiplap joint. In various embodiments, male forward shiplap surface 244 and male outward shiplap surface 248 may be formed into a complimentary shiplap joint using any suitable method. For example, male forward shiplap surface 244 and male outward shiplap surface 248 may be milled or be otherwise machined down to form a shiplap joint. Similarly, male forward shiplap surface 244 and male outward shiplap surface 248 may be formed through EDM, wherein the desired shiplap joint is obtained by using electrical discharges to erode the metal surface of male end 240.

In various embodiments, female forward shiplap surface 234 may be configured to operatively interface with male forward shiplap surface 244 when female end 230 is coupled to male end 240. In this regard, female forward shiplap surface 234 may be formed as a shiplap joint having a protrusion extending axially outward from the surface of female end 230, and male forward shiplap surface 244 may be formed as a shiplap joint comprising a void extending axially inward from the surface of male end 240. Female forward shiplap surface 234 may therefore be complimentary to male forward shiplap surface 244, such that the protrusion defining female forward shiplap surface 234 may operatively fit within the void defining male forward shiplap surface 244. Female forward shiplap surface 234 may also be formed as any suitable rabbet joint, i.e., a rectangular groove along a surface edge, with male forward shiplap surface 244 formed as a complimentary rabbet joint having a rectangular edge opposite of the rectangular groove of female forward shiplap surface 234.

In various embodiments, female outward shiplap surface 238 may be configured to operatively interface with male outward shiplap surface 248 when female end 230 is coupled to male end 240. In this regard, female outward shiplap surface 238 may be formed as a shiplap joint comprising a void extending axially inward from the surface of female end 230, and male outward shiplap surface 248 may be formed as a shiplap joint comprising a protrusion extending axially outward from the surface of male end 240. Female outward shiplap surface 238 may therefore be complimentary to male outward shiplap surface 248, such that the protrusion defining male outward shiplap surface 248 may operatively fit within the void defining female outward shiplap surface 238. Female outward shiplap surface 238 may also be formed as any suitable rabbet joint, i.e., a rectangular groove along a surface edge, with male outward shiplap surface 248 formed as a complimentary rabbet joint having a rectangular edge opposite of the rectangular groove of female outward shiplap surface 238.

Figure 3A:
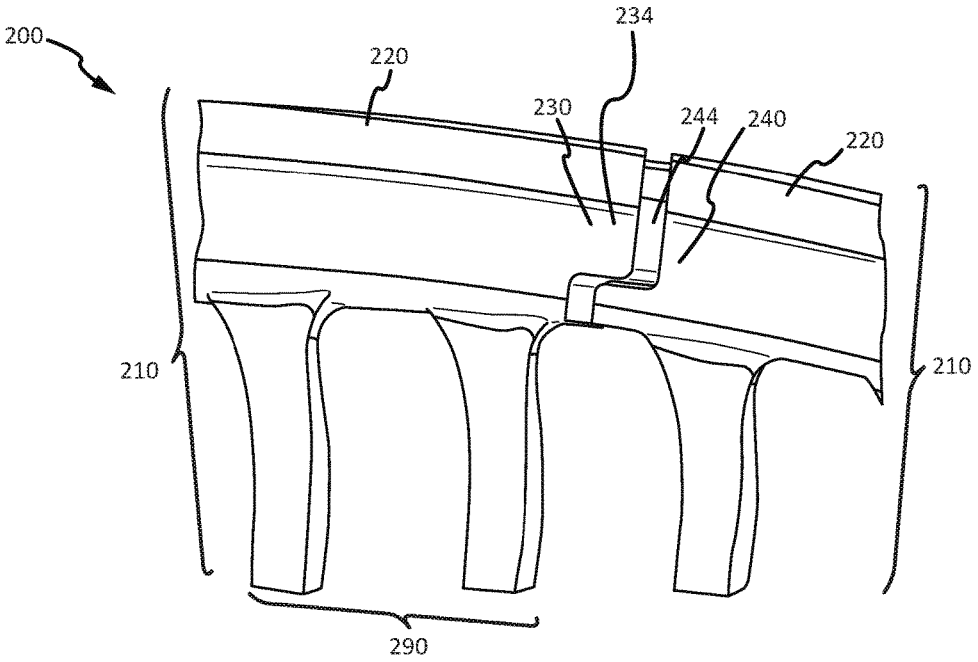
FIG. 3A illustrates a perspective side view of a stator vane shiplap seal assembly, in accordance with various embodiments.
Figure 3B:
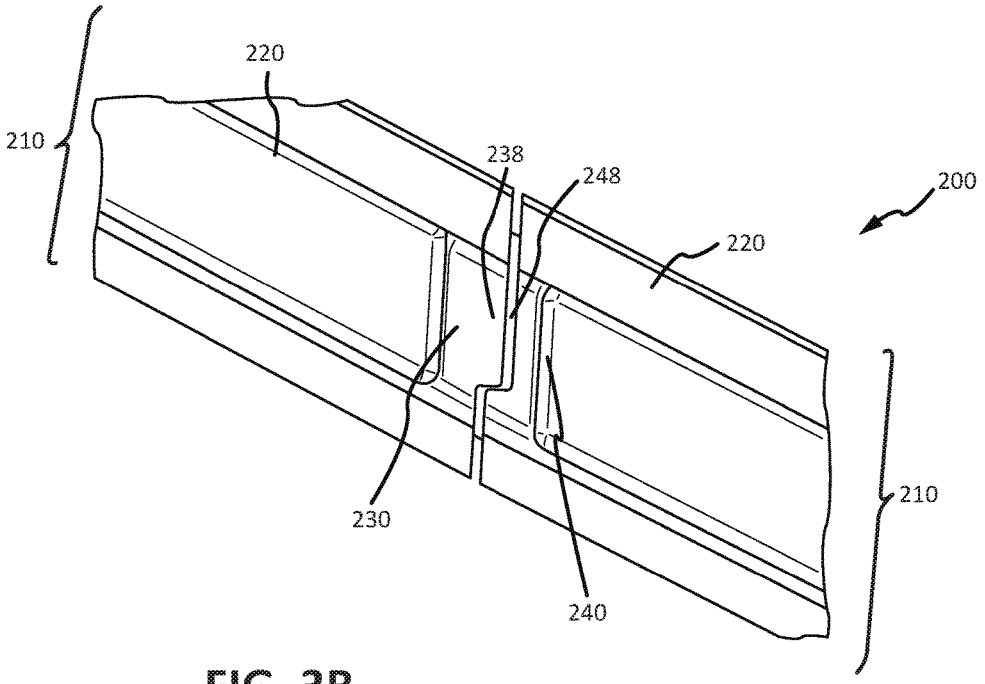
FIG. 3B illustrates a perspective top view of a stator vane shiplap seal assembly, in accordance with various embodiments.

In various embodiments, the geometry of the complimentary shiplap joints in female forward shiplap surface 234 and male forward shiplap surface 244 and female outward shiplap surface 238 and male outward shiplap surface 248 may be varied to any suitable size and shape capable of minimizing air flow leakage by creating a more tortuous leakage path. In various embodiments, and with reference to FIGS. 3A and 3B, an additional example of a shiplap stator vane assembly is provided. With respect to FIGS. 3A, 3B, and 4, elements with like element numbering as depicted in FIGS. 2A-2D are intended to be the same and will not be repeated for the sake of clarity.

Figure 4:
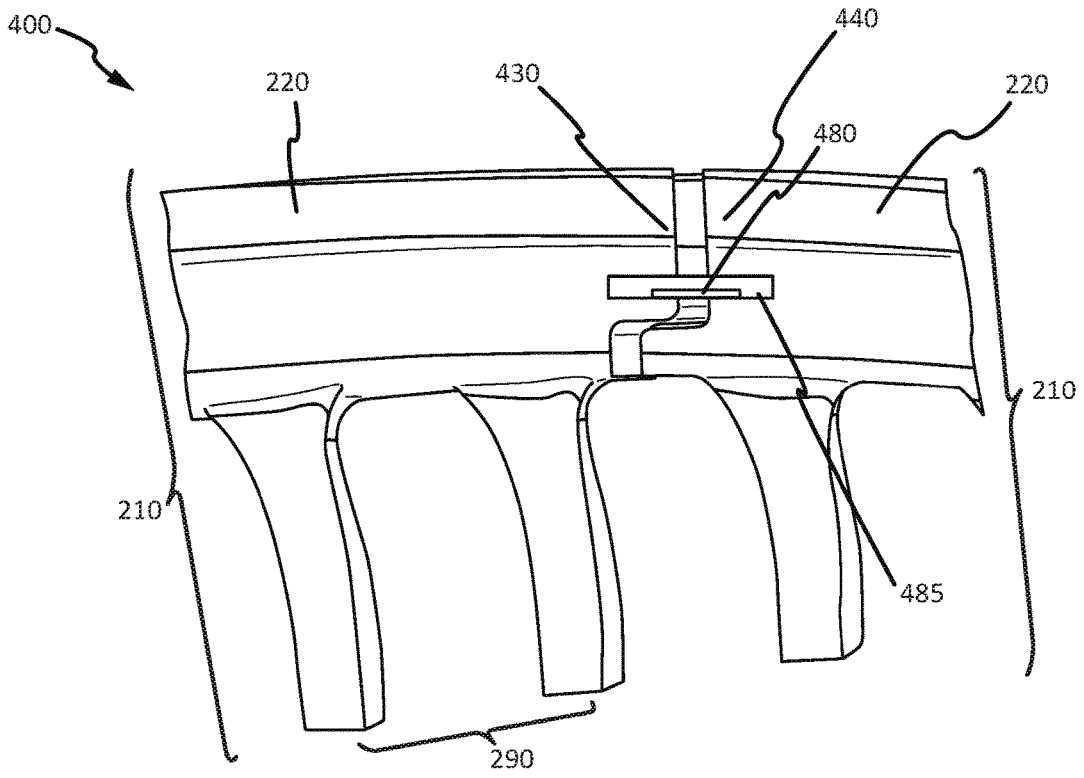
FIG. 4 illustrates a perspective side view of a stator vane shiplap seal assembly, in accordance with various embodiments.

In various embodiments and with reference to FIG. 4, stator vane shiplap seal assembly 400 may also comprise a feather seal 480. Feather seal 480 may be configured to further minimize air flow leakage in stator vane shiplap seal assembly 400. In this regard, feather seal 480 may be located in any location suitable to minimize air flow leakage in stator vane shiplap seal assembly 400. For example, and in various embodiments, a feather seal slot 485 may be configured to fit feather seal 480. Feather seal slot 485 may comprise a void machined into female end 430 and male end 440. Feather seal slot 485 may comprise any shape and size suitable to fit feather seal 480, such as, for example, a rectangular shape. Feather seal 480 may also be located within an inter-segment gap created by the coupling of adjacent shiplap stator shrouds. The use of feather seal 480 in feather seal slot 485 may further minimize air flow leakage in the radial direction (from axis of rotation 120). Feather seal 480 may comprise any shape, size, and material suitable to further minimize air flow leakage. For example, feather seal 480 may comprise a small flat metal part, machined to size to fit within feather seal slot 485.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures. The scope of the disclosures is accordingly to be limited by nothing other than the appended claims and their legal equivalents, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A stator vane shiplap seal assembly, comprising:

a first shiplap stator cluster coupled to a second shiplap stator cluster, each shiplap stator cluster comprising:

an outer shiplap stator shroud having an axially outward surface and an axially inward surface, and a female end opposite a male end, wherein the female end comprises a female forward shiplap surface and a female outward shiplap surface, wherein the female forward shiplap surface comprises a first female forward recess located proximate the axially outward surface, a second female forward recess located proximate the axially inward surface, and a first female forward protrusion located between the first female forward recess and the second female forward recess, and wherein the female outward shiplap surface comprises a first female outward protrusion and a first female outward recess, and wherein the male end comprises a male forward shiplap surface and a male outward shiplap surface, wherein the male forward shiplap surface comprises a first male forward protrusion located proximate the axially outward surface, a second male forward protrusion located proximate the axially inward surface, and a first male recess located between the first male forward protrusion and the second male forward protrusion, and wherein the male outward shiplap surface comprises a first male outward recess and a first male outward protrusion, and wherein the female forward shiplap surface is complimentary to the male forward shiplap surface, forming an axial shiplap seal in response to the first shiplap stator cluster being coupled to the second shiplap stator cluster, and wherein the female outward shiplap surface is complimentary to the male outward shiplap surface, forming a radial shiplap seal in response to the first shiplap stator cluster being coupled to the second shiplap stator cluster; and at least one stator vane coupled to the axially inward surface of the outer shiplap stator shroud.

2. The stator vane shiplap seal assembly of claim 1, further comprising a feather seal slot machined into the female end and the male end of each of the first shiplap stator cluster and the second shiplap stator cluster.

3. The stator vane shiplap seal assembly of claim 2, further comprising a feather seal located within the feather seal slot of each of the first shiplap stator cluster and the second shiplap stator cluster.

4. The stator vane shiplap seal assembly of claim 1, wherein the female forward shiplap surface and the female outward shiplap surface of at least one of the first shiplap stator cluster or the second shiplap stator cluster are formed by machining.

5. The stator vane shiplap seal assembly of claim 1, wherein the female forward shiplap surface and the female outward shiplap surface of at least one of the first shiplap stator cluster or the second shiplap stator cluster are formed through electrical discharge machining.

6. The stator vane shiplap seal assembly of claim 1, wherein the male forward shiplap surface and the male outward shiplap surface of at least one of the first shiplap stator cluster or the second shiplap stator cluster are formed by machining.

7. The stator vane shiplap seal assembly of claim 1, wherein the male forward shiplap surface and the male outward shiplap surface of at least one of the first shiplap stator cluster or the second shiplap stator cluster are formed through electrical discharge machining.

8. A shiplap stator cluster, comprising:

an outer shiplap stator shroud having an axially outward surface and an axially inward surface, and a female end opposite a male end, wherein the female end comprises a female forward shiplap surface and a female outward shiplap surface, wherein the female forward shiplap surface comprises a first female forward recess located proximate the axially outward surface, a second female forward recess located proximate the axially inward surface, and a first female forward protrusion located between the first female forward recess and the second female forward recess, and wherein the female outward shiplap surface comprises a first female outward protrusion and a first female outward recess, and wherein the male end comprises a male forward shiplap surface and a male outward shiplap surface, wherein the male forward shiplap surface comprises a first male forward protrusion located proximate the axially outward surface, a second male forward protrusion located proximate the axially inward surface, and a first male recess located between the first male forward protrusion and the second male forward protrusion, and wherein the male outward shiplap surface comprises a first male outward recess and a first male outward protrusion, and wherein the female forward shiplap surface is complimentary to the male forward shiplap surface, forming an axial shiplap seal in response to the shiplap stator cluster being coupled to a second shiplap stator cluster, and wherein the female outward shiplap surface is complimentary to the male outward shiplap surface, forming a radial shiplap seal in response to the shiplap stator cluster being coupled to the second shiplap stator cluster; and at least one stator vane coupled to the axially inward surface of the outer shiplap stator shroud.

9. The shiplap stator cluster of claim 8, wherein the axially outward surface of the outer shiplap stator shroud is configured to operatively couple to an axially inward surface of a compressor section of a gas turbine engine.

10. The shiplap stator cluster of claim 8, wherein the female forward shiplap surface and the female outward shiplap surface are formed by machining.

11. The shiplap stator cluster of claim 8, wherein the female forward shiplap surface and the female outward shiplap surface are formed through electrical discharge machining.

12. The shiplap stator cluster of claim 8, wherein the male forward shiplap surface and the male outward shiplap surface are formed by machining.

13. The shiplap stator cluster of claim 8, wherein the male forward shiplap surface and the male outward shiplap surface are formed through electrical discharge machining.

14. A gas turbine engine comprising:

a compressor section; and a stator vane shiplap seal assembly in the compressor section, the stator vane shiplap seal assembly comprising:

a first shiplap stator cluster coupled to a second shiplap stator cluster, each shiplap stator cluster comprising:

an outer shiplap stator shroud having an axially outward surface and an axially inward surface, and a female end opposite a male end, wherein the female end comprises a female forward shiplap surface and a female outward shiplap surface, wherein the female forward shiplap surface comprises a first female forward recess located proximate the axially outward surface, a second female forward recess located proximate the axially inward surface, and a first female forward protrusion located between the first female forward recess and the second female forward recess, and wherein the female outward shiplap surface comprises a first female outward protrusion and a first female outward recess, and wherein the male end comprises a male forward shiplap surface and a male outward shiplap surface, wherein the male forward shiplap surface comprises a first male forward protrusion located proximate the axially outward surface, a second male forward protrusion located proximate the axially inward surface, and a first male recess located between the first male forward protrusion and the second male forward protrusion, and wherein the male outward shiplap surface comprises a first male outward recess and a first male outward protrusion, and wherein the female forward shiplap surface is complimentary to the male forward shiplap surface, forming an axial shiplap seal in response to the first shiplap stator cluster being coupled to the second shiplap stator cluster, and wherein the female outward shiplap surface is complimentary to the male outward shiplap surface, forming a radial shiplap seal in response to the first shiplap stator cluster being coupled to the second shiplap stator cluster; and at least one stator vane coupled to the axially inward surface of the outer shiplap stator shroud.

15. The gas turbine engine of claim 14, further comprising a feather seal slot machined into the female end and the male end each of the first shiplap stator cluster and the second shiplap stator cluster.

16. The gas turbine engine of claim 15, further comprising a feather seal located within the feather seal slot of each of the first shiplap stator cluster and the second shiplap stator cluster.

17. The gas turbine engine of claim 14, wherein the female forward shiplap surface and the female outward shiplap surface of at least one of the first shiplap stator cluster or the second shiplap stator cluster are formed by machining.

18. The gas turbine engine of claim 14, wherein the female forward shiplap surface and the female outward shiplap surface of at least one of the first shiplap stator cluster or the second shiplap stator cluster are formed through electrical discharge machining.

19. The gas turbine engine of claim 14, wherein the male forward shiplap surface and the male outward shiplap surface of at least one of the first shiplap stator cluster or the second shiplap stator cluster are formed by machining.

20. The gas turbine engine of claim 14, wherein the male forward shiplap surface and the male outward shiplap surface of at least one of the first shiplap stator cluster or the second shiplap stator cluster are formed through electrical discharge machining.

* * * * *